US010233681B2

(12) United States Patent
Ueda et al.

(10) Patent No.: US 10,233,681 B2
(45) Date of Patent: Mar. 19, 2019

(54) VEHICLE DOOR LOCKING DEVICE

(71) Applicant: NABTESCO CORPORATION, Tokyo (JP)

(72) Inventors: Shinji Ueda, Hyogo (JP); Atsuhito Yamaguchi, Hyogo (JP); Hiroki Uno, Hyogo (JP); Shinsuke Yamada, Hyogo (JP)

(73) Assignee: Nabtesco Corporation, Tokyo (JP)

( * ) Notice: Subject to any disclaimer, the term of this patent is extended or adjusted under 35 U.S.C. 154(b) by 0 days.

(21) Appl. No.: 14/925,192

(22) Filed: Oct. 28, 2015

(65) Prior Publication Data

US 2016/0123047 A1 May 5, 2016

(30) Foreign Application Priority Data

Oct. 31, 2014 (JP) ..... 2014-222522

(51) Int. Cl.
*E05B 81/04* (2014.01)
*E05B 81/08* (2014.01)
(Continued)

(52) U.S. Cl.
CPC ..... *E05B 81/08* (2013.01); *B61D 19/026* (2013.01); *E05B 81/14* (2013.01); *E05B 81/21* (2013.01);
(Continued)

(58) Field of Classification Search
CPC ..... E05B 81/00; E05B 81/04; E05B 81/21; E05B 83/363; E05B 85/243; E05B 81/08;
(Continued)

(56) References Cited

U.S. PATENT DOCUMENTS 3,782,034 A * 1/1974 Lynn ..... E05F 15/649 105/341
4,901,474 A * 2/1990 Bayard ..... E05F 15/565 292/144
(Continued)

FOREIGN PATENT DOCUMENTS

CN 103161386 A 6/2013
CN 103452391 A 12/2013
(Continued)

OTHER PUBLICATIONS

Extended European Search Report as issued in European Patent Application No. 15191830.7, dated Mar. 31, 2016.
(Continued)

*Primary Examiner* — James O Hansen
(74) *Attorney, Agent, or Firm* — Pillsbury Winthrop Shaw Pittman, LLP

(57) ABSTRACT

A vehicle door locking device includes a switching portion capable of switching between a first state in which the switching portion makes contact with a door to inhibit the door from moving in an opening direction no less than a distance required for removing an object caught in the door, and a second state in which the movement of the door of no less than the distance is not inhibited. The switching portion has a cam that rotates according to an opening/closing operation of the door. The rotation of the cam by a predetermined angle or more is inhibited in the first state, and the rotation of the cam is allowed in the second state.

16 Claims, 7 Drawing Sheets

(51) Int. Cl.

| | |
|---|---|
| ***E05B 81/20*** | (2014.01) |
| ***B61D 19/02*** | (2006.01) |
| ***E05B 83/36*** | (2014.01) |
| ***E05B 81/14*** | (2014.01) |
| ***E05B 83/40*** | (2014.01) |
| ***E05B 85/26*** | (2014.01) |

(52) U.S. Cl.
CPC ..... *E05B 83/363* (2013.01); *E05B 83/40* (2013.01); *E05B 85/26* (2013.01)

(58) Field of Classification Search
CPC ..... E05B 81/14; E05B 83/40; E05B 85/26; E05C 3/00; E05C 3/12; E05C 3/22; E05C 3/24; E05C 3/26; E05C 3/28; B61D 19/026
USPC ... 292/44, 45, 194, 197, 201, 216, 219, 220; 49/116, 118, 122
See application file for complete search history.

(56) References Cited

U.S. PATENT DOCUMENTS 5,678,869 A * 10/1997 Yoshikuwa ..... E05B 81/66 292/216
5,944,367 A 8/1999 Imaizumi et al.
2013/0152477 A1 6/2013 Choi
2013/0340346 A1 12/2013 Ueda et al.
2015/0054294 A1* 2/2015 Uno ..... E05B 81/06 292/194

FOREIGN PATENT DOCUMENTS

| | | | |
|---|---|---|---|
| DE | 197 17 638 | A1 | 11/1997 |
| EP | 2 447 130 | A1 | 5/2012 |
| JP | 11-165635 | A | 6/1999 |
| JP | 2002-089109 | A | 3/2002 |
| TW | 527463 | B | 4/2003 |
| TW | 553861 | B | 9/2003 |
| TW | I221816 | B | 10/2004 |
| WO | WO 2012/120790 | A1 | 9/2012 |

OTHER PUBLICATIONS

Office Action as issued in Taiwanese Patent Application No. 104135481, dated Jul. 19, 2016.
Office Action as issued in Chinese Patent Application No. 201510727663.8, dated May 2, 2017.
Notification of Reasons for Refusal issued in corresponding Japanese Patent Application No. 2014-222522 dated Jan. 22, 2019 with English translation.

* cited by examiner

VEHICLE DOOR LOCKING DEVICE

TECHNICAL FIELD

The present invention relates to a vehicle door locking device.

BACKGROUND ART

Conventionally, a vehicle door locking device is known as disclosed in Japanese Patent Application Publication No. 2002-89109 and WO 2012/120790A1. Specifically, as illustrated in FIG. 8, a locking device disclosed in Japanese Patent Application Publication No. 2002-89109 includes a lock arm 82 and a rotating member 83 provided on an attachment plate 81 so as to be rotatable. The rotating member 83 rotates when an engagement pin 84 provided on a door enters an engagement groove 83*a* of the rotating member 83. The lock arm 82 can be positioned at a lock position at which a distal end thereof makes contact with a distal end surface 83*b* of the rotating member 83 to lock the rotating member 83 and a unlock position at which the distal end thereof is separated from the distal end surface 83*b* of the rotating member 83 to allow rotation of the rotating member 83. A lock switching pin 85 is provided on a lower side of the lock arm 82 so as to advance or retract. With movement of the lock switching pin 85, the lock arm 82 moves to the lock position or the unlock position. When the lock arm 82 is at the lock position, since rotation of the rotating member 83 is inhibited, it is not possible to move the door. On the other hand, when the lock arm 82 is at the unlock position, an opening/closing operation of the door is allowed.

A locking device disclosed in WO 2012/120790A1 is switched from an unlock state to a lock state based on a velocity signal of a vehicle. That is, the locking device is switched to the lock state when the vehicle starts moving and the velocity thereof reaches a predetermined velocity rather than switching the locking device to the lock state when the door is closed. Thus, even when an object is caught in the door, as long as the vehicle is in a stopped state, it is possible to open the door and to easily remove the caught object.

In the locking device disclosed in Japanese Patent Application Publication No. 2002-89109, when the door is at a closed position, the rotation of the rotating member 83 is restricted by the lock arm 82. Thus, when an object or the like is caught in the door, it is not possible to operate the door in an opening direction. Thus, it is difficult to remove the object or the like caught in the door.

On the other hand, in. WO 2012/120790A1, since the door is not locked until the velocity of a train reaches a predetermined velocity, although it is possible to remove the object or the like caught in the door, the door may be opened unexpectedly.

SUMMARY OF INVENTION

An object of the present invention is to provide a vehicle door locking device capable of securing the safety of occupants in the vehicle while enabling an object or the like caught in a door to be easily removed.

An aspect of the present invention provides a vehicle door locking device, including: a switching portion capable of switching between a first state in which the switching portion makes contact with a door to inhibit the door from moving in an opening direction no less than a distance required for removing an object caught in the door, and a second state in which the movement of the door of no less than the distance is not inhibited.

DESCRIPTION OF EMBODIMENTS

Hereinafter, embodiments of the present invention will be described in detail with reference to the drawings.

Figure 1:
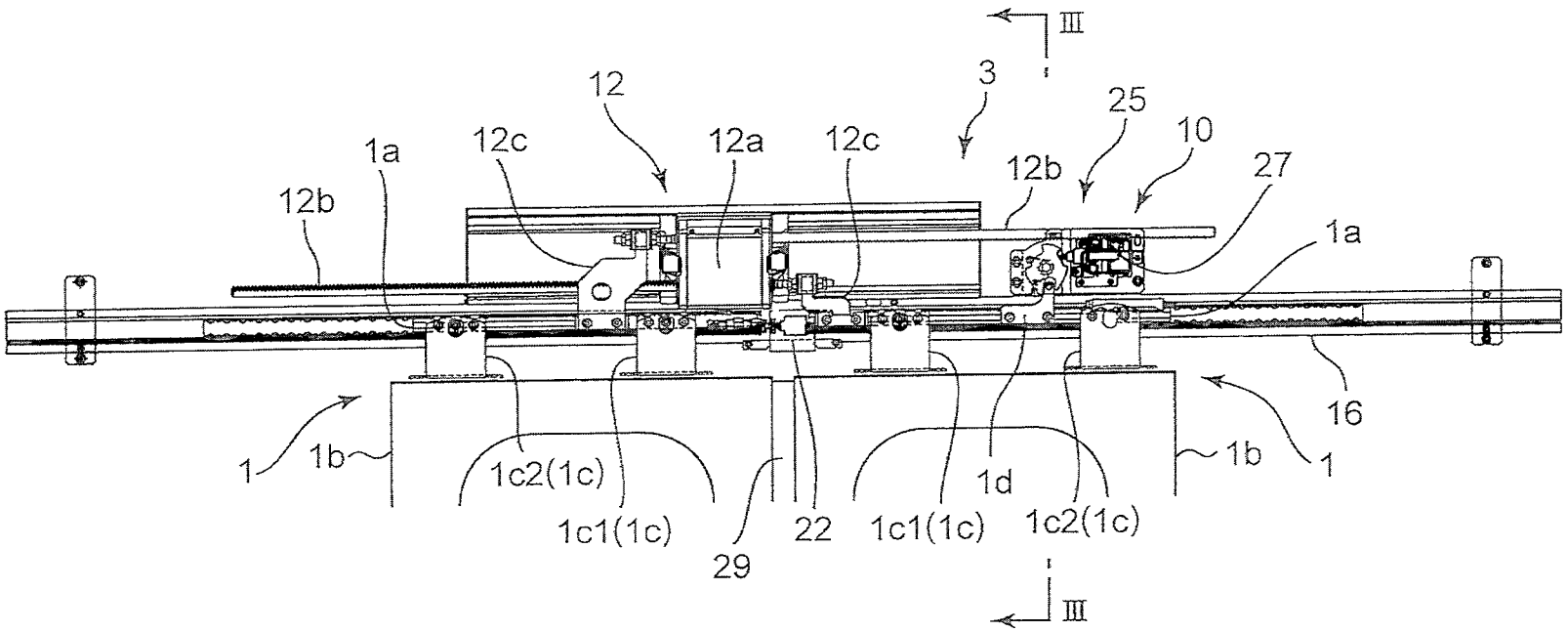
FIG. 1 is a diagram illustrating a vehicle door to which a locking device according to an embodiment of the present invention is applied.

As illustrated in FIG. 1, a locking device 10 of a vehicle door 3 according to the present embodiment is configured to lock the vehicle door 3 having a double-sided sliding door 1 that opens or closes an entrance formed on a side wall of the body of a railway vehicle.

The vehicle door 3 includes an opening/closing device 12 that drives the door 1 to be opened or closed. The opening/closing device 12 includes a motor 12*a* as a driving source that generates driving force for driving the door 1, a rack 12*b* which is a long member that linearly moves upon receiving the driving force of the motor 12*a*, and a connecting member 12*c* that connects the rack 12*b* and the door 1. In the present embodiment, a pair of doors 1 is provided, and accordingly, a pair of racks 12*b* and a pair of connecting members 12*c* are provided. In the case of a single-sided sliding door 1, one rack 12*b* and one connecting member 12*c* are provided. In the present embodiment, although the rack 12*b* moves linearly to move the door 1 to be opened or closed, the present invention is not limited thereto. For example, the vehicle door 3 may include a belt-driven opening/closing device and may include an opening/closing device that drives the door 1 by rotating a ball screw.

The door 1 includes a slider 1*a* that moves along a rail 16 extending in a moving direction of the door 1, a door body 1*b*, a suspending member 1*c* provided on an upper portion of the door body 1*b* and fixed to the slider 1*a*, and a protruding portion 1*d* fixed to the slider 1*a* so as to stop the movement of the slider 1*a* (the door 1) by the locking device 10. The suspending member 1*c* has a first suspending bracket 1*c*1 provided in a portion of the upper end of the door body 1*b* close to a door end side and a second suspending bracket 1*c*2 provided in a portion close to a door trail side of the door body 1*b*. That is, the protruding portion 1*d* is provided in the door 1. The protruding portion 1*d* is fixed to a portion of the slider 1*a* between the first suspending bracket 1*c*1 and the second suspending bracket 1*c*2. The position of the protruding portion 1*d* is not limited to that position.

The motor (a geared motor) 12*a* is thin and is formed in a rectangular shape in a side view thereof and is disposed above the entrance. Moreover, the motor 12*a* is fixed to a support member 18 (see FIG. 3) provided in a vehicle body B.

The pair of racks 12*b* engage with a pinion (not illustrated) incorporated into the motor 12*a*. The rack (first rack) 12*b* positioned on the upper side is driven to move leftward in FIG. 1 when the motor 12*a* generates driving force in an opening direction. On the other hand, the rack (second rack) 12*b* positioned on the lower side is driven to move rightward in FIG. 1 when the motor 12*a* generates driving force in an opening direction.

Each connecting member 12*c* is connected to one end (the end in the opening direction) of each rack 12*b*. The connecting member 12*c* has an upper end connected to the rack 12*b* and a lower end connected to the slider 1*a*. The connecting member 12*c* may be connected to an end in a closing direction of the rack 12*b*.

Figure 3:
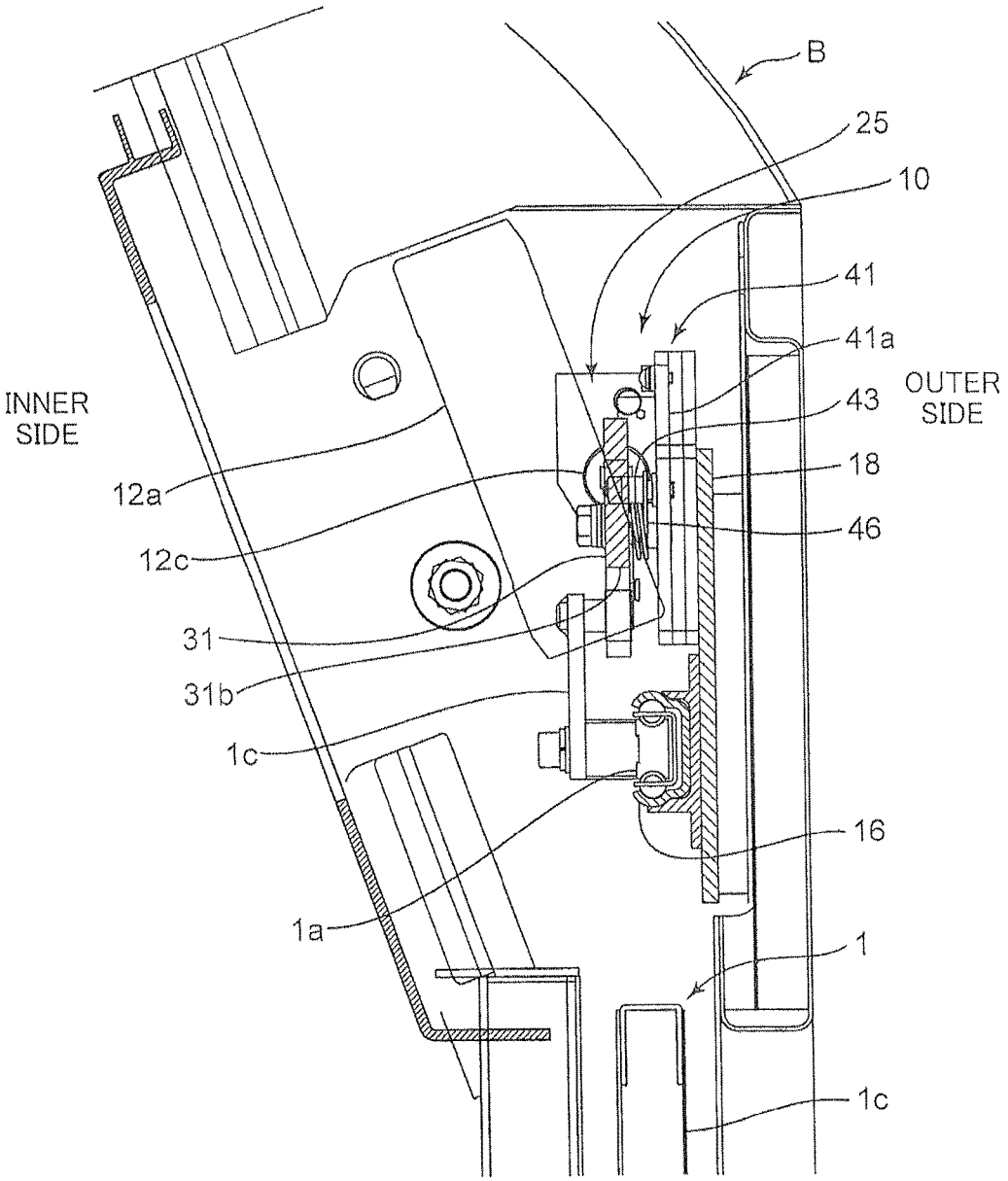
FIG. 3 is a cross-sectional view along line in FIG. 1.

The rail 16 is fixed to the support member 18 provided on a side wall of the vehicle body B and is disposed at a position immediately above the entrance so as to extend in a width direction (a front-rear direction of the vehicle body) of the entrance. As illustrated in FIG. 3, the rail 16 has upper and lower holding walls formed thereon and the slider 1*a* is held on both holding wall surfaces.

The slider 1*a* is a member that has a long shape in an extension direction of the rail 16 and is held on the rail 16 so as to be movable. The slider 1*a* is exposed through a gap between the holding wall surfaces of the rail 16. The connecting member 12*c*, the first suspending bracket 1*c*1, the second suspending bracket 1*c*2, and the protruding portion 1*d* are connected to the slider 1*a* through the gap.

The first suspending bracket 1*c*1 has an upper end connected to the slider 1*a* and a lower end connected to an upper surface of the door body 1*b*. The second suspending bracket 1*c*2 has the same configuration as the first suspending bracket 1*c*1.

The protruding portion 1*d* has a lower end thereof is connected to the slider 1*a* and is formed in such a shape that the protruding portion extends upward from the lower end.

As illustrated in FIG. 1, a door closing switch 22 is provided in the vehicle door 3. The door closing switch 22 is provided so that it can be recognized that the door 1 is closed up to a predetermined closed position and is configured to be turned on when the door 1 is moved to the predetermined closed position. When the door closing switch 22 is turned on, the door closing switch 22 outputs a signal. The signal is used for sending a notification or the like to a cab.

The closed position is a position shifted slightly in an opening direction from a position (a reference position) at which it is to be recognized that the door 1 is in a closed state in a normal time such as during traveling of a vehicle. The reference position is a position shifted slightly in the opening direction from a fully closed position at which the door 1 advances furthest in the closing direction when a closing operation is performed. Thus, the closed position is a position located closer to an open side than the reference position and the fully closed position of the door 1. The driving force of the motor 12*a* decreases when the door 1 reaches the fully closed position and a predetermined period elapses. Thus, the door 1 is slightly pushed back toward the reference position from the fully closed position.

Figure 2:
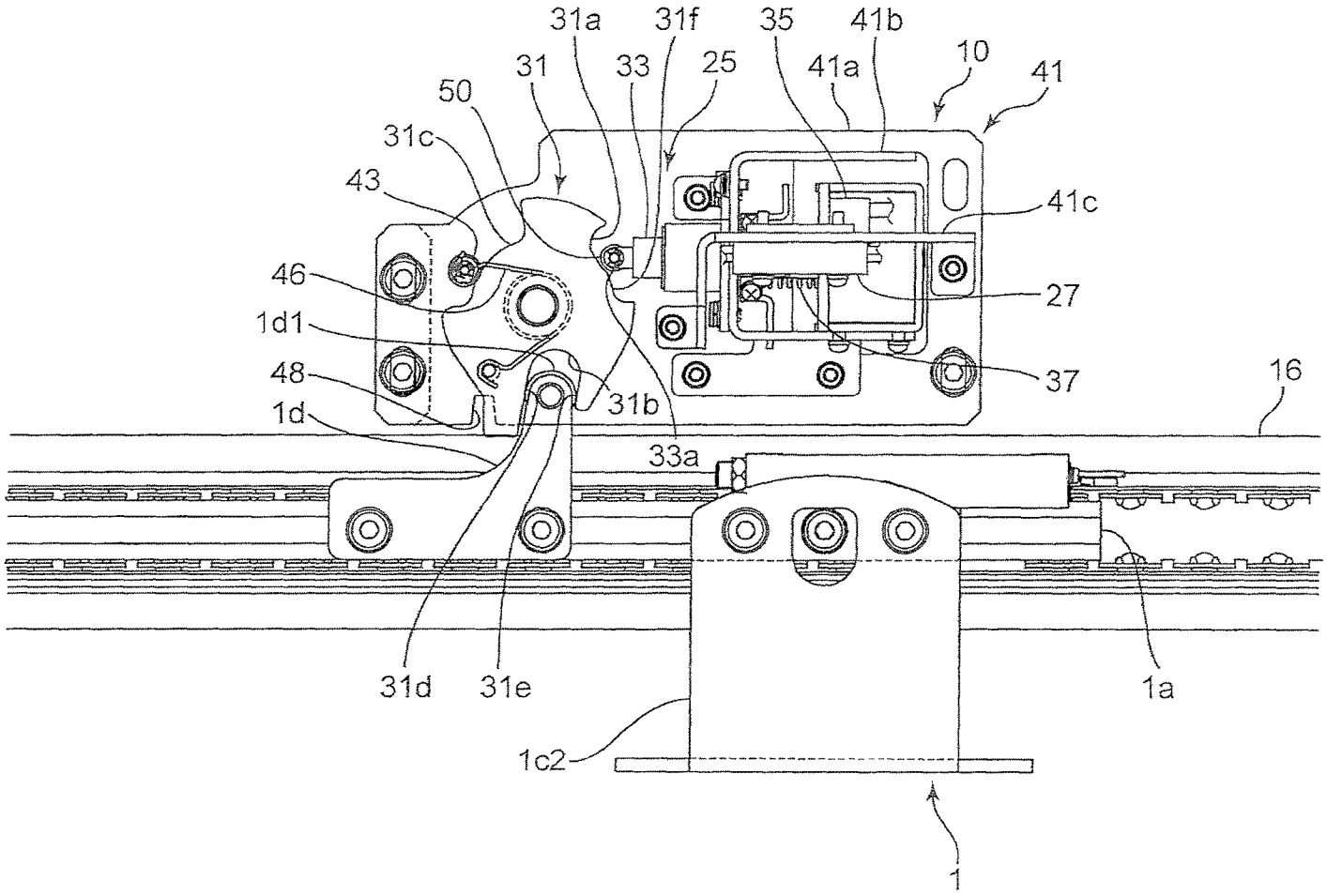
FIG. 2 is a diagram illustrating the locking device.

As illustrated in FIGS. 2 and 3, the locking device 10 includes a switching portion 25 that is configured switched between a first state and a second state and a lock switch 27 that outputs a lock signal indicating that the door 1 is locked by being turned on. The first state is a state in which constituent elements of the locking device 10 make contact with the door 1 to inhibit the door 1 from moving in the opening direction no less than a distance required for removing an object caught in the door 1. The second state is a state in which the movement of the door 1 of no less than the distance is not inhibited.

The moving distance of the door 1 allowed to remove an object caught in the door 1 is a predetermined distance. For example, the moving distance of the door 1 may be set such that a gap through which a person cannot pass is formed in the entrance. Alternatively, the moving distance of the door 1 may be set such that a gap through which the leg or the arm of a person cannot pass is formed in the entrance. Alternatively, the moving distance of the door 1 may be set such that a gap narrower than the aforementioned gap is formed in the entrance. For example, the moving distance may be set to be equal to or less than a width, in the opening/closing direction of the door 1, of a rubber member (door end rubber) 29 provided in the door end of the door 1. In this case, since the door 1 can be moved within the range of the width of the rubber member 29, it is possible to remove a caught object by deformation of the rubber member 29 and to secure the safety of the occupants in the vehicle.

The switching portion 25 includes a cam 31 provided so as to be rotatable, a plunger 33 that can reciprocate in one direction, a solenoid 35 that generates driving force for driving the plunger 33, and a spring member 37 that has elastic force for moving the plunger 33 in one direction. The solenoid 35 is configured to generate driving force for moving the plunger 33 while resisting the elastic force of the spring member 37. In the present embodiment, the solenoid 35 is provided so that the plunger 33 moves in a horizontal direction (the left-right direction in FIG. 2).

The plunger 33 is disposed in an attitude that the plunger 33 extends in a direction parallel to the cam 31. Moreover, the moving direction of the plunger 33 is parallel to the cam 31. That is, the moving direction of the plunger 33 is perpendicular to a rotation shaft of the cam 31. Thus, it is possible to suppress the thickness in the width direction of the locking device 10.

The switching portion 25 is attached to an attachment member 41 fixed to the vehicle body B. The attachment member 41 includes a base plate member 41*a* of which the shape (see FIG. 2) when seen from the inside of the vehicle body B toward the outside in the width direction is formed in an approximately rectangular shape, a first attachment portion 41*b* fixed to the base plate member 41*a*, and a second attachment portion 41*c* fixed to the base plate member 41*a*. The cam 31 is supported on the base plate member 41*a* so as to be rotatable. The solenoid 35 and the spring member 37 are supported on the first attachment portion 41*b*. The lock switch 27 is fixed to the second attachment portion 41*c*. The cam 31 is disposed close to one side of the base plate member 41*a* and the first and second attachment portions 41*b* and 41*c* are disposed close to the other side of the base plate member 41*a*.

The cam 31 is formed of one plate member and is configured to rotate about a shaft extending in the width direction of the vehicle body B. That is, the rotation shaft of the cam 31 is in an attitude that the rotation shaft extends in a horizontal direction perpendicular to the moving direction of the door 1.

A first groove 31*a* in which the plunger 33 can enter, a second groove 31*b* in which the protruding portion 1*d* of the door 1 can enter, and a third groove 31*c* are formed in the cam 31.

The second groove 31*b* is positioned on a lower side of the rotation shaft of the cam 31. A width of the second groove 31*b* in the rotating direction of the cam 31 corresponds to the width of a distal end 1*d*1 of the protruding portion 1*d*. Moreover, an edge (the left edge in FIG. 2) 31*d*, in the closing direction of the door, of the second groove 31*b* serves as a receiver that receives pressing force from the protruding portion 1*d* when the door 1 performs a closing operation. Moreover, an edge (the right edge in FIG. 2) 31*e*, in the opening direction of the door 1, of the second groove 31*b* serves as a receiver that receives pressing force from the protruding portion 1*d* when the door 1 performs an opening operation. Moreover, when the distal end 1*d*1 of the protruding portion 1*d* enters the second groove 31*b* with linear movement of the protruding portion 1*d* according to the closing operation of the door 1, the cam 31 rotates about the shaft unless the plunger 33 enters the first groove 31*a* as will be described later. That is, the cam 31 is configured to rotate within a predetermined angular range according to the opening/closing operation of the door 1.

The first groove 31*a* is formed at such a position that the first groove 31*a* moves in an up-down direction when the cam 31 rotates. That is, in the present embodiment, since the plunger 33 is provided so as to move in a horizontal direction, the first groove 31*a* is set so as to move in the up-down direction with rotation of the cam 31. The position of the first groove 31*a* may be set according to the moving direction of the plunger 33, and the first groove 31*a* may be set so as to move in a direction crossing the moving direction of the plunger 33 when the cam 31 rotates. In this way, the plunger 33 entering the first groove 31*a* can inhibit rotation of the cam 31 more than a predetermined range. In other words, the plunger 33 functions as an operating portion for inhibiting the rotation of the cam 31.

The width of the first groove 31*a* in the rotating direction of the cam 31 is larger than the width of the distal end 33*a* of the plunger 33 that can enter the first groove 31*a*. In the present embodiment, since a roller 50 that rolls along a bottom surface 31*f* of the first groove 31*a* during rotation of the cam 31 is formed at the distal end of the plunger 33, the width of the distal end 33*a* of the plunger 33 is larger than the outer diameter of the roller 50. Moreover, an interval between opposite edges of the first groove 31*a* in the rotating direction of the cam 31 is larger than the width of the distal end 33*a* of the plunger 33. Thus, even when the distal end 33*a* of the plunger 33 is in the first groove 31*a*, the cam 31 can rotate within a range in which the distal end 33*a* of the plunger 33 makes contact with the edge of the first groove 31*a*. Thus, the cam 31 can rotate within a certain range when the distal end 33*a* of the plunger 33 is in the first groove 31*a*. This rotation range is a range in which the door 1 is allowed to move in the opening direction by the aforementioned moving distance.

The distance that the door 1 moves in the closing direction further from the closed position at which the door closing switch 22 is turned on is very small. However, in this case, the distance is set such that, even when the cam 31 rotates, the distal end 33*a* of the plunger 33 does not make contact with the edge (the upper edge in FIG. 2) of the first groove 31*a* of the cam 31.

Figure 4:
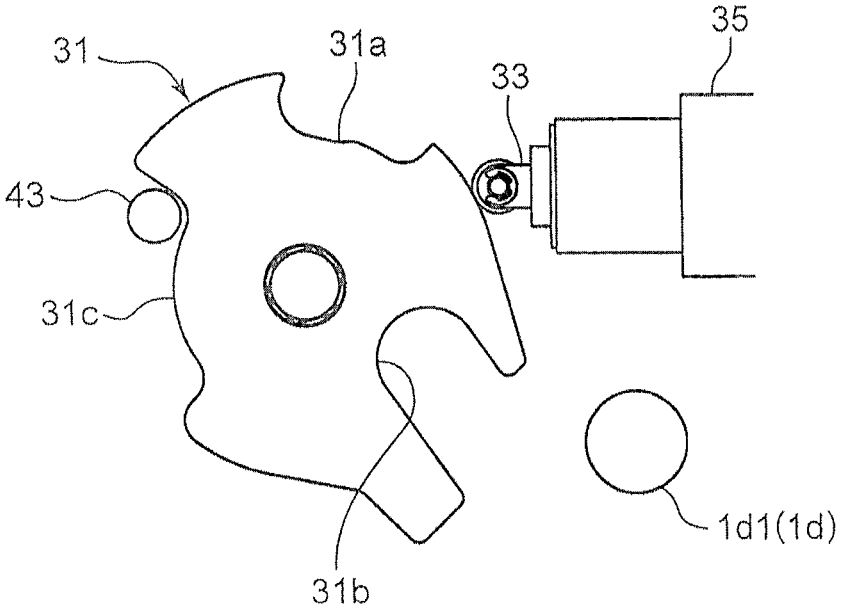
FIG. 4 is a diagram illustrating a state in which a cam of the locking device is at a reception attitude.

A restricting member 43 is disposed in the third groove 31*c*. The restricting member 43 is fixed to the base plate member 41*a* of the attachment member 41. When the restricting member 43 is disposed in the third groove 31*c*, the third groove 31*c* can restrict the cam 31 restricted by the first groove 31*a* from rotating over the rotating range of the earn 31, and the rotating range of the cam 31 during a normal opening/closing operation of the door 1 is restricted. That is, the restricting member 43 makes contact with one edge (the upper edge in FIG. 2) of the third groove 31*c* in the rotating direction, whereby rotation of the cam 31 is restricted so that the cam 31 does not rotate further in a counter-clockwise direction. As illustrated in FIG. 4, the attitude of the cam 31 at this time is a reception attitude in which the protruding portion 1*d* moving in the closing direction can be received by the second groove 31*b*. When the cam 31 is at the reception attitude, the lower edge of the first groove 31*a* is positioned above the plunger 33 that is at a retracted position described later. In other words, when the cam 31 is at the reception attitude, the first groove 31*a* is moved up to a position shifted from the position of the plunger 33 in the rotating direction of the cam 31.

The restricting member 43 may not be provided in the third groove 31*c*. In this case, the rotation angular range of the cam 31 can be restricted by a torsion spring 46 described later.

The cam 31 is rotated in a direction (the counter-clockwise direction in FIG. 2) in which the second groove 31*b* moves in the closing direction by the protruding portion 1*d* that enters the second groove 31*b* and moves in the closing direction. When the door 1 reaches a closed position at which the door closing switch 22 is turned on, the cam 31 is at an attitude that the cam 31 is rotated in the counter-clockwise direction slightly further than the attitude illustrated in FIG. 2. When the door 1 moves from the closed position to reach the reference position, the cam 31 rotates slightly in the clockwise direction to be positioned at the attitude illustrated in FIG. 2. In the attitude of the cam 31 in which the door 1 moves from the closed position toward the reference position, the plunger 33 can enter the first groove 31*a*.

The cam 31 receives force that rotates the cam 31 in one direction from the torsion spring 46. One end of the torsion spring 46 is fixed to the restricting member 43, and the other end of the torsion spring 46 is fixed to the earn 31. Thus, the cam 31 is at the reception attitude in a state in which the protruding portion 1*d* does not enter the second groove 31*b* and the operating portion (plunger 33) does not enter the first groove 31*a*. One end of the torsion spring 46 may be fixed to the attachment member 41 rather than the restricting member 43.

A mark 48 for aligning the attitude of the cam 31 with a reference attitude is formed on the attachment member 41. That is, since the width of the first groove 31*a* in the rotating direction of the cam 31 is sufficiently larger than the width of the distal end 33*a* of the plunger, the attitude of the cam 31 can be set to the reference attitude using the mark 48 when the can 31 is attached to the attachment member 41. In the reference attitude, the distal end 33*a* of the plunger 33 is positioned exactly at the center of the first groove 31*a*. In the present embodiment, although the mark 48 is formed by notching a lower end of the base plate member 41*a* of the attachment member 41, the present invention is not limited thereto. A protruding mark 48 may be formed and the color of the mark 48 may be changed so that the mark 48 can be identified from the surrounding portion.

Here, the configuration, operation, and function of the switching portion 25 will be described in detail.

The solenoid 35 of the switching portion 25 is configured to operate the plunger 33 so that the distal end 33*a* of the plunger 33 moves between an entering position at which the distal end 33*a* enters the first groove 31*a* and a retracted position at which the distal end 33*a* is retracted from the first groove 31*a*.

When the plunger 33 is at the entering position, the switching portion 25 is in a first state in which the door 1 is inhibited from moving in the opening direction no less than the aforementioned moving distance. That is, when the switching portion 25 is in the first state, the door 1 is allowed to move in the opening direction by a distance smaller than a distance in which the movement is allowed in order to remove an object caught in the door 1 whereas the movement by a distance longer than the distance is inhibited. In this case, the plunger 33 makes contact with an edge (the lower edge in FIG. 2) of the first groove 31*a* of the cam 31 whereby the rotation of the cam 31 is stopped within a predetermined angular range. That is, in a state in which the plunger 33 is at the entering position, the rotating range of the cam 31 corresponds to the width of the first groove 31*a*. In other words, the cam 31 and the plunger 33 are in a lock state in which the opening operation (the movement of the protruding portion 1*d*) of the door 1 of no less than the distance is mechanically inhibited. Moreover, when the plunger 33 is at the entering position, the lock switch 27 is turned on. That is, the entering position is an ON position at which the lock switch 27 is turned on.

On the other hand, when the plunger 33 is at the retracted position, the switching portion 25 is in a second state in which the movement (the movement of the protruding portion 1*d*) of the door 1 is not inhibited. That is, when the switching portion 25 is in the second state, the cam 31 can rotate within a range exceeding the width of the first groove 31*a*. In this way, the opening/closing operation of the door 1 is allowed. In other words, the cam 31 and the plunger 33 are in an unlock state in which the opening operation of the door 1 of no less than the distance is allowed. Moreover, when the plunger 33 is at the retracted position, the lock switch 27 is not turned on. That is, the retracted position is an OFF position at which the lock switch 27 is not turned on. Thus, the plunger 33 functions as an operating portion that can move between the ON position at which the plunger 33 enters the first groove 31*a* formed in the cam 31 to turn the lock switch 27 on and the OFF position at which the plunger 33 is retracted from the first groove 31*a* to turn the lock switch 27 off.

The solenoid 35 is excited based on a command for starting an operation of closing the door 1 and is demagnetized when a predetermined period elapses after the door 1 moves up to the fully closed position beyond the closed position. The predetermined period corresponds to a period required for the door 1 having moved up to the fully closed position beyond a position at which the door closing switch 22 is turned on to be pushed back in the opening direction and stopped. That is, the switching portion 25 is configured to demagnetize the solenoid 35 after the elapse of a period required for the door 1 having moved up to the fully closed position beyond a position at which the door closing switch 22 is turned on to be pushed back in the opening direction and stopped.

The spring member 37 of the switching portion 25 generates force that presses the plunger 33 from the retracted position toward the entering position. Thus, when the solenoid 35 is demagnetized, the plunger 33 is positioned at the entering position (the ON position). On the other hand, in a state in which the solenoid 35 is excited, the plunger 33 is positioned at the retracted position (the OFF position).

An outer circumferential surface of the cam 31 between the first groove 31*a* and the second groove 31*b* is positioned on an extension line in the moving direction of the plunger 33 when the cam 31 is in the reception attitude. Even if the solenoid 35 is demagnetized when the cam 31 is in the reception attitude, the plunger 33 makes contact with the outer circumferential surface of the cam 31 between the first groove 31*a* and the second groove 31*b*. Thus, the plunger 33 is inhibited from moving to the ON position. That is, the cam 31 has such a shape that the plunger 33 is inhibited from moving to the ON position while the door 1 is moving up to the closed position.

When the plunger 33 is at the entering position, the distal end 33*a* of the plunger 33 makes contact with the bottom surface 31*f* of the first groove 31*a*. The bottom surface 31*f* of the first groove 31*a* has such a circular are shape that the plunger 33 is not pushed back from the entering position (the ON position) toward the retracted position (the OFF position) during rotation of the cam 31.

Although FIG. 2 illustrates a configuration in which, when the door 1 moves in the opening direction, the cam 31 rotates in the counter-clockwise direction and the lower edge of the first groove 31*a* makes contact with the distal end 33*a* of the plunger 33, the present invention is not limited thereto. For example, a configuration in which, when the door 1 moves in the opening direction, the cam 31 rotates so that the upper edge of the first groove 31*a* makes contact with the distal end 33*a* of the plunger 33 may be employed.

Next, an operation of the vehicle door locking device 10 according to the present embodiment will be described. When the door 1 is at an open position, the cam 31 is in the reception attitude (see FIG. 4) by the spring force of the torsion spring 46. In this case, since the solenoid 35 is demagnetized, the distal end 33*a* of the plunger 33 is in contact with the outer circumferential surface (a portion between the first groove 31*a* and the second groove 31*b*) of the cam 31. Moreover, the solenoid 35 is excited based on a command for starting the operation of closing the door 1 (time t1 in FIG. 5). As a result, the plunger 33 is separated from the outer circumferential surface of the cam 31, whereby the cam 31 enters an unlock state in which the cam 31 can be rotated according to the operation of the door 1. When the motor 12*a* is driven and the pair of racks 12*b* moves linearly, the slider 1*a* moves. As a result, the door 1 is moved from the open position toward the fully closed position (performs a closing operation). The protruding portion 1*d* enters the second groove 31*b* immediately before the door 1 reaches the closed position. As a result, the cam 31 starts rotating.

Figure 5:
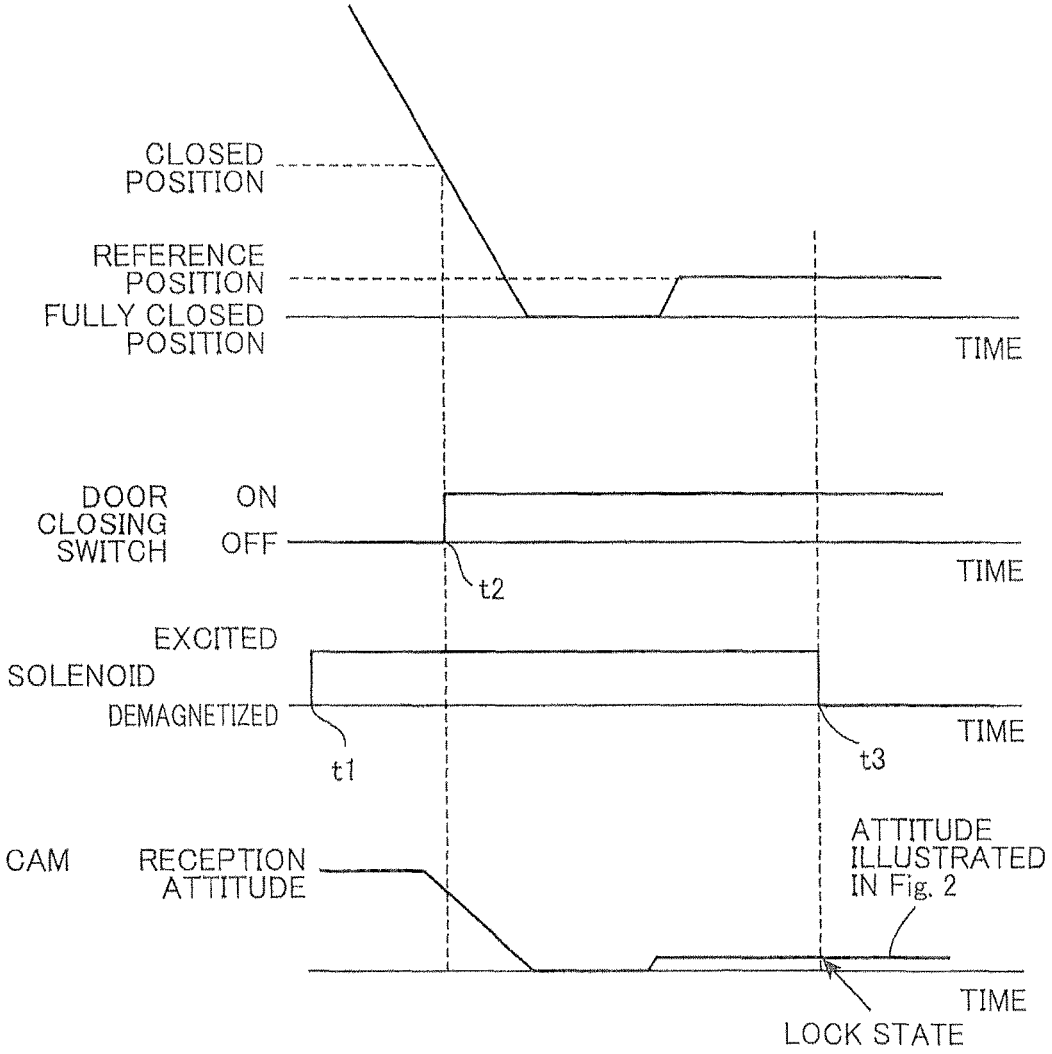
FIG. 5 is a timing chart for describing an operation of the locking device.

When the door 1 reaches the closed position, the door closing switch 22 is turned on (time t2 in FIG. 5). When the door 1 is at the closed position, the cam 31 is in such an attitude that a portion of the outer circumferential surface of the cam 31 between the first groove 31*a* and the second groove 31*b* is positioned on the extension line of the plunger 33. Moreover, the door 1 continues the closing operation by moving from the closed position further to the fully closed position and the earn 31 continues rotating in the clockwise direction. After that, after reaching the fully closed position, the door 1 is pushed back slightly in the opening direction from the fully closed position to stop at the reference position, and the cam 31 also stops. After that, the solenoid 35 is demagnetized (time t3 in FIG. 5). As a result, the plunger 33 enters the first groove 31*a*. In this way, the cam 31 and the plunger 33 enters a lock state and the switching portion 25 enters the first state. In the first state, since the cam 31 can rotate within a predetermined angular range, the protruding portion 1*d* positioned in the second groove 31*b* can move within the distance range. Thus, the protruding portion 1*d* is inhibited from moving no less than the range of the distance. The door 1 is also inhibited from moving no less than the distance in the opening direction.

The timing at which the solenoid 35 is demagnetized is set to occur after a predetermined period from the time at which the door 1 reaches the fully closed position. Alternatively, the timing is set to occur after a predetermined period from the time at which the door 1 reaches the fully closed position and the driving force of the motor 12*a* decreases. Alternatively, the timing is set to occur after a predetermined period from the time at which the door closing switch 22 is turned on. In any case, the solenoid 35 waits for the elapse of a period required for the door 1 having moved up to the fully closed position beyond the closed position to be pushed back in the opening direction and to stop at the reference position, and then the solenoid 35 is demagnetized.

Even when the cam 31 is in the lock state, the cam 31 can rotate within a predetermined angular range (within the width range of the first groove 31*a*) by the movement of the protruding portion 1*d* within the second groove 31*b*. Thus, when an object or the like is caught between the doors 1 (door catching occurs), it is possible to move the door 1 in the opening direction by the above-described distance. Thus, it is possible to remove an object or the like caught between the doors 1 easily. On the other hand, since rotation of the cam 31 exceeding a predetermined angle is inhibited mechanically, the door 1 is not opened exceeding the predetermined distance. Thus, it is possible to secure the safety of the occupants in the vehicle.

When the door 1 performs the opening operation, the solenoid 35 is excited when the locking device 10 receives a command for starting the operation of opening the door 1. As a result, the plunger 33 is moved from the entering position to the retracted position. In this way, the cam 31 enters the unlock state. After that, the motor 12*a* is driven and the door 1 performs the opening operation.

As described above, in the present embodiment, when the switching portion 25 is in the first state, the door 1 can be moved by a distance as long as the distance is within a distance range in which the movement is allowed in order to remove an object caught in the door 1. Thus, even when an object is caught between the door 1 and a counterpart member (that is, the other door 1 in the case of a double-sided door 1 or an opening edge of the vehicle body B in the case of a single-sided door) (hereinafter, this will be also referred to as door catching occurs), it is possible to remove the caught object by moving the door 1 within the distance range. In such a case, since the opening operation of the door 1 of no less than the distance is inhibited when the door 1 makes contact with the switching portion 25, it is possible to secure the safety of the occupants in the vehicle.

Moreover, in the present embodiment, since the switching portion 25 has the cam 31 that rotates according to the opening/closing operation of the door 1, it is possible to rotate the cam 31 without providing an additional driving device for rotating the cam 31. Moreover, by switching the state of the cam 31 by the movement of the plunger 33 between a state in which the rotation of the cam 31 is allowed and a state in which rotation of the cam 31 by a predetermined angle or more is inhibited, it is possible to switch the state of the switching portion 25 between the first state and the second state.

Moreover, in the present embodiment, when the door 1 is at the closed position (a position at which the door closing switch 22 is turned on), the cam 31 is in such an attitude that the portion of the outer circumferential surface of the cam 31 between the first groove 31*a* and the second groove 31*b* is positioned on the extension line of the plunger 33. Thus, it is possible to mechanically prevent the lock switch 27 from being turned on before the door 1 moves to a position at which the door closing switch 22 is turned on. On the other hand, after the door 1 moves up to the closed position, even when the door 1 moves in the opening direction slightly from the closed position due to the occurrence of door catching, the lock switch 27 can be maintained to the ON state. This is because the distal end 33*a* of the plunger 33 is positioned in the first groove 31*a*. Thus, it is possible to prevent the output of a lock signal from being temporarily stopped due to door catching.

Moreover, in the present embodiment, the width of the first groove 31*a* of the cam 31 in the rotating direction is larger than the width of the distal end 33*a* of the plunger 33. Thus, when the plunger 33 is removed from the first groove 31*a*, the cam 31 rotates with the movement of the protruding portion 1*d* provided in the door 1. Therefore, the cam 31 does not become an obstacle to the opening/closing operation of the door 1. On the other hand, when the plunger 33 is at the ON position at which the plunger 33 is inserted in the first groove 31*a*, although the cam 31 can rotate until the plunger 33 makes contact with the edge of the first groove 31*a*, further rotation (by a predetermined angle or more) is inhibited. Thus, it is possible to inhibit the opening operation of the door 1 by the width or more of the first groove 31*a*.

Moreover, in the present embodiment, the bottom surface 31*f* of the first groove 31*a* of the cam 31 has such a circular arc shape that the plunger 33 is not pushed back from the ON position toward the OFF position during rotation of the cam 31. Thus, it is possible to prevent the plunger 33 from being separated from the ON position during rotation of the cam 31. That is, it is possible to prevent the occurrence of a state in which a lock signal is not output during rotation of the cam 31.

Moreover, in the present embodiment, since the roller 50 is provided at the distal end of the plunger 33, it is possible to secure smooth rotation of the cam 31.

Moreover, in the present embodiment, the width of the second groove 31*b* in the rotating direction of the cam 31 is formed in a size corresponding to the width of the distal end 1*d*1 of the protruding portion 1*d*, entering the second groove 31*b*. Thus, when the position of the protruding portion 1*d* is shifted in relation to the door body 1*b*, the cam 31 changes its attitude in the rotating direction. However, the width of the first groove 31*a* in the rotating direction of the cam 31 is larger than the width of the distal end 33*a* of the plunger 33. Thus, even when the cam 31 is rotated, it is possible to easily insert the distal end 33*a* of the plunger 33 into the first groove 31*a*. Therefore, even when the position of the protruding portion 1*d* is shifted in relation to the door 1, it is possible to absorb the positional shift.

Moreover, in the present embodiment, since the width of the first groove 31*a* is larger than the width of the distal end 33*a* of the plunger 33, it is possible to allow the cam 31 to be rotated from the designed attitude. Further, since the mark 48 that can be used when attaching the cam 31 is formed, it is possible to improve the workability of an attaching operation during attachment of the cam 31.

Moreover, in the present embodiment, the solenoid 35 is not demagnetized immediately when the door 1 is moved up to a position at which the door closing switch 22 is turned on during the closing operation of the door 1. Thus, the operating portion does not necessarily move up to the ON position even when the door closing switch 22 is turned on. Due to this, even when the door 1 is pushed back to move in the opening direction after moving up to the fully closed position beyond the position at which the door closing switch 22 is turned on and returns to the reference position, the plunger 33 does not move to the ON position. Therefore, it is possible to prevent information indicating that the plunger 33 is at the ON position from being temporarily transmitted to a driver.

Figure 6:
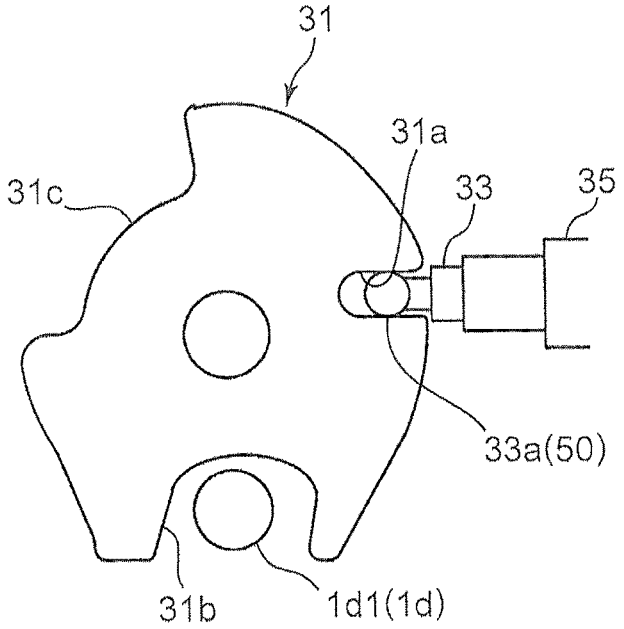
FIG. 6 is a diagram for describing a locking device according to another embodiment of the present invention.

The present invention is not limited to the embodiment but various changes and improvements can be made without departing from the spirit thereof. For example, the width of the first groove 31*a* is formed to be larger than the width of the distal end 33*a* of the plunger 33, and the width of the second groove 31*b* is formed in a size corresponding to the width of the distal end 1*d*1 of the protruding portion 1*d*. Instead of this, as illustrated in FIG. 6, the width of the first groove 31*a* may be formed in a size corresponding to the width of the distal end 33*a* of the plunger 33, and the width of the second groove 31*b* may be formed to be larger than the width of the distal end 1*d*1 of the protruding portion 1*d*. In this case, the width of the second groove 31*b* in the rotating direction of the cam 31 may be formed so as to correspond to the distance. When the plunger 33 is at the entering position at which the plunger 33 enters the first groove 31*a*, the cam 31 does not rotate. That is, when the plunger 33 is in the first groove 31*a* and the rotation of the cam 31 is inhibited, the edge of the second groove 31*b* stops the protruding portion 1*d* having moved inside the second groove 31*b* in the opening direction. In this state, the protruding portion 1*d* can move inside the second groove 31*b* in the opening direction within the distance range. That is, the switching portion 25 is configured to be capable of switching between a first state in which the switching portion 25 makes contact with the door 1 to inhibit the door 1 from moving in the opening direction no less than the distance required for removing an object caught in the door 1, and a second state in which the movement of the door 1 of no less than the distance is not inhibited.

In the present embodiment, the rotation of the cam 31 is inhibited by the plunger 33 entering the first groove 31*a*. In this embodiment, since the width of the second groove 31*b* in the rotating direction of the cam 31 is formed to be larger than the width of the distal end 1*d*1 of the protruding portion 1*d*, it is possible to move the protruding portion 1*d* (that is, the door 1) in the opening direction until the protruding portion 1*d* makes contact with the edge of the second groove 31*b*. Thus, when door catching occurs, it is possible to remove the caught object or the like.

Figure 7:
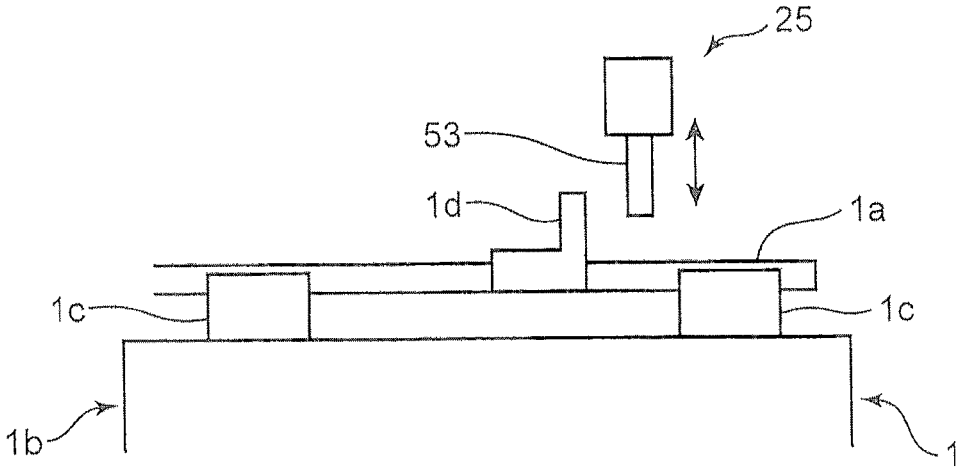
FIG. 7 is a diagram for describing a locking device according to another embodiment of the present invention.
Figure 8:
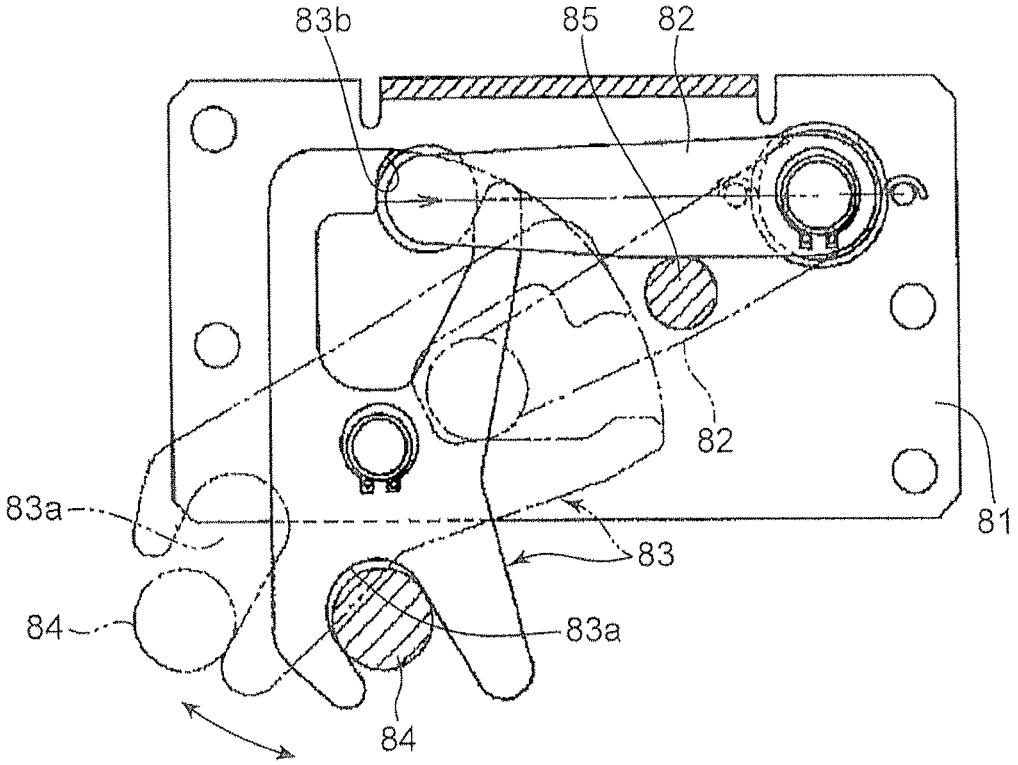
FIG. 8 is a diagram illustrating a conventional locking device.

In the embodiment, although the switching portion 25 includes the cam 31 that can rotate, the present invention is not limited thereto. For example, as illustrated in FIG. 7, the switching portion 25 may include a lock member 53 provided so as to reciprocate linearly. The lock member 53 is set to a position shifted in the opening direction by the distance from the position of the protruding portion 1*d* when the door 1 is closed.

The lock member 53 is configured to move in an up-down direction, for example. When the lock member 53 moves downward, the lock member 53 is positioned so as to be able to make contact with the protruding portion 1*d* and a lock state in which the movement of the protruding portion 1*d* in the opening direction of no less than a predetermined distance is inhibited is created. That is, the switching portion 25 enters the first state. On the other hand, when the lock member 53 moves upward, the lock member 53 is positioned so as to be unable to make contact with the protruding portion 1*d*, and an unlock state is created. That is, the switching portion 25 enters the second state.

In the drawing, although the lock member 53 is configured to move in the up-down direction, the present invention is not limited thereto, but the lock member 53 may move in a horizontal direction.

The lock member 53 may be configured as the plunger 33 of the solenoid 35 or may be fixed to the plunger 33.

Here, the embodiment will be summarized.

(1) In the embodiment, when the switching portion is in the first state, the door can be moved by a distance as long as the distance is within a distance range in which the movement is allowed in order to remove an object caught in the door. Thus, even when an object is caught between the door and a counterpart member (that is, the other door in the case of a double-sided door or an opening edge of the vehicle body in the case of a single-sided door) (hereinafter, this will be also referred to as door catching occurs), it is possible to remove the caught object by moving the door within the distance range. In such a case, since the opening operation of the door of no less than the distance is inhibited when the door makes contact with the switching portion, it is possible to secure the safety of the occupants in the vehicle.

(2) The switching portion may have a cam that rotates according to the opening/closing operation of the door. In this case, the rotation of the cam by a predetermined angle or more may be inhibited in the first state and the rotation of the cam may be allowed in the second state.

In this aspect, since the switching portion has the cam that rotates according to the opening/closing operation of the door, it is possible to rotate the cam without providing an additional driving device for rotating the cam. Moreover, by switching the state of the cam between a state in which the rotation of the cam is allowed and a state in which rotation of the cam by a predetermined angle or more is inhibited, it is possible to switch the state of the switching portion between the first state and the second state.

(3) A lock switch that is turned on to output a lock signal indicating that the door is locked may be provided in a vehicle. In this case, the switching portion may have an operating portion capable of moving between an ON position at which the operating portion enters a first groove formed in the cam to turn the lock switch on, and an OFF position at which the operating portion is retracted from the first groove to turn the lock switch off. The cam may have such a shape that the operating portion is inhibited from moving to the ON position until the door moves to a position at which a door closing switch is turned on.

In this aspect, it is possible to mechanically prevent the lock switch from being turned on before the door moves to a position at which the door closing switch is turned on. On the other hand, after the door moves up to the closed position, even when the door moves in the opening direction slightly from the closed position due to the occurrence of door catching, the lock switch can be maintained to the ON state. Thus, it is possible to prevent the output of a lock signal from being temporarily stopped due to door catching.

(4) The operating portion positioned in the first groove is configured to stop the rotation of the cam within the range of the predetermined angle by making contact with an edge of the first groove.

In this aspect, when the operating portion is removed from the first groove and is positioned at the OFF position, the cam rotates with the movement of the protruding portion provided in the door. Thus, the cam does not become an obstacle to the opening/closing operation of the door. On the other hand, when the operating portion is at the ON position at which the operating portion is inserted in the first groove, although the cam can rotate until the operating portion makes contact with the edge of the first groove, further rotation (by a predetermined angle or more) is inhibited. Thus, it is possible to inhibit the opening operation of the door.

(5) The operating portion may be configured to make contact with a bottom surface of the first groove when the operating portion is at the ON position. In this case, the bottom surface may have such a circular arc shape that the operating portion is not pushed back from the ON position toward the OFF position during rotation of the cam.

In this aspect, it is possible to prevent the operating portion from being separated from the ON position during rotation of the cam. That is, it is possible to prevent the occurrence of a state in which a lock signal is not output during rotation of the cam.

(6) A roller that rolls along the bottom surface during rotation of the cam may be formed at a distal end of the operating portion. In this aspect, it is possible to secure smooth rotation of the cam.

(7) A second groove in which a protruding portion formed in the door can be inserted may be formed in the cam. In this case, a width of the second groove in a rotating direction of the cam may be formed in a size corresponding to a width of a distal end of the protruding portion that enters the second groove, and a width of the first groove in the rotating direction of the cam may be formed to be larger than a width of a distal end of the operating portion that is inserted into the first groove.

In this aspect, the width of the second groove in the rotating direction of the cam is formed in a size corresponding to the width of the distal end of the protruding portion that enters the second groove. Thus, when the position of the protruding portion is shifted in relation to the door, the cam changes its attitude in the rotating direction. However, the width of the first groove in the rotating direction of the cam is larger than the width of the distal end of the operating portion. Thus, even when the cam is rotated, it is possible to easily insert the distal end of the operating portion into the first groove. Therefore, even when the position of the protruding portion is shifted in relation to the door, it is possible to absorb the positional shift.

(8) A mark for determining an attitude of the cam may be formed in the lock device. In this aspect, since the width of the first groove is larger than the width of the distal end of the operating portion, it is possible to allow the cam to be rotated from the designed attitude. Further, since the mark that can be used when attaching the cam is formed, it is possible to improve the workability of an attaching operation during attachment of the cam.

(9) A second groove in which a protruding portion formed in the door can be inserted may be formed in the cam. In this case, a width of the second groove in a rotating direction of the cam may be formed to be larger than a width of a distal end of the protruding portion that is inserted into the second groove, and an edge of the second groove may be configured to stop the protruding portion having moved inside the second groove in the opening direction when the operating portion is in the first groove and the rotation of the cam is inhibited.

In this aspect, the rotation of the cam is inhibited by the operating portion entering the first groove. In this state, since the width of the second groove in the rotating direction of the cam is formed to be larger than the width of the distal end of the protruding portion, it is possible to move the protruding portion (that is, the door) in the opening direction until the protruding portion makes contact with the edge of the second groove. Thus, when door catching occurs, it is possible to remove the caught object or the like.

(10) The switching portion may have a solenoid that moves the operating portion to the ON position or the OFF position, and may be configured to move the operating portion to the ON position by the solenoid being demagnetized. In this case, the switching portion may be configured to demagnetize the solenoid after the elapse of a period required for the door having moved up to a fully closed position beyond a position at which the door closing switch is turned on to be pushed back in the opening direction and stopped.

In this aspect, the solenoid is not demagnetized immediately when the door is moved up to a position at which the door closing switch is turned on during the closing operation of the door. Thus, the operating portion does not necessarily move up to the ON position even when the door closing switch is turned on. Due to this, even when the door is pushed back to move in the opening direction after moving up to the fully closed position beyond the position at which the door closing switch is turned on, the operating portion does not move to the ON position. Therefore, it is possible to prevent information indicating that the operating portion is at the ON position from being temporarily transmitted to a driver.

(11) The distance required for removing the object caught in the door may be set to be equal to or less than a width, in the opening/closing direction of the door, of a rubber member provided at a door end of the door.

In this aspect, since the door can be moved within the range of the width of the rubber member provided in the door end of the door, it is possible to remove a caught object by deformation of the rubber member and to secure the safety of the occupants in the vehicle.

(12) The operating portion may have a plunger capable of reciprocating in one direction between a position at which the plunger enters the first groove and a position at which the plunger is retracted from the first groove.

As described above, according to the embodiment, it is possible to provide a vehicle door locking device capable of securing the safety of occupants in the vehicle while enabling an object or the like caught in a door to be easily removed.

This application is based on Japanese Patent application No. 2014-222522 filed in Japan Patent Office on Oct. 31, 2014, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A vehicle door locking device for locking a door of a vehicle, comprising:

a switching portion having a cam that rotates according to an opening operation of a vehicle door or a closing operation of the vehicle door, and an operation portion that is engageable with the cam to restrict a rotation of the cam, wherein the cam includes a first groove for receiving a part of the operation portion for restricting rotation of the cam, wherein the first groove has a first range which allows the cam to rotate such that the vehicle door moves in an opening direction for a limited distance required for removing an object caught by the vehicle door and restricts the cam from rotating such that the vehicle door does not move in the opening direction more than the limited distance when the part of the operation is in the first groove, wherein the rotation of the cam is allowed when the part of the operation portion is out of the first groove, wherein the vehicle is provided with a door closing switch which outputs a door closing signal indicating that the door is closed, and a lock switch that outputs a lock signal indicating that the door is locked when being turned on, wherein the operating portion is configured for moving between an ON position at which the operating portion enters the first groove to turn the lock switch on, and an OFF position at which the operating portion is retracted from the first groove to turn the lock switch off, wherein the cam has such a shape that keeps the operating portion from reaching the ON position until the door closing switch is turned on, wherein the first groove has an edge which comes into contact with the part of the operating portion to stop the rotation of the cam, wherein the first groove has a bottom surface which comes into contact with the operating portion when the operating portion is at the ON position, wherein the bottom surface has such a circular arc shape that keeps the operating portion from moving from the ON position to the OFF position during rotation of the cam, and wherein the part of the operation portion has a roller that rolls along the bottom surface of the first groove during rotation of the cam.

2. A vehicle door locking device for locking a door of a vehicle, comprising:

a switching portion having a cam that rotates according to an opening operation of a vehicle door or a closing operation of the vehicle door, and an operation portion that is engageable with the cam to restrict a rotation of the cam, wherein the cam includes a first groove for receiving a part of the operation portion for restricting rotation of the cam, wherein the first groove has a first range which allows the cam to rotate such that the vehicle door moves in an opening direction for a limited distance required for removing an object caught by the vehicle door and restricts the cam from rotating such that the vehicle door does not move in the opening direction more than the limited distance when the part of the operation is in the first groove, wherein the rotation of the cam is allowed when the part of the operation portion is out of the first groove, wherein the vehicle is provided with a door closing switch which outputs a door closing signal indicating that the door is closed, and a lock switch that outputs a lock signal indicating that the door is locked when being turned on, wherein the operating portion is configured for moving between an ON position at which the operating portion enters the first groove to turn the lock switch on, and an OFF position at which the operating portion is retracted from the first groove to turn the lock switch off, wherein the cam has such a shape that keeps the operating portion from reaching the ON position until the door closing switch is turned on, wherein the first groove has an edge which comes into contact with the part of the operating portion to stop the rotation of the cam, wherein the cam includes a second groove for receiving a protruding portion formed in the door, wherein a width of the second groove in a rotating direction of the cam is a size corresponding to a width of a distal end of the protruding portion that enters the second groove, and wherein a width of the first groove in the rotating direction of the cam is larger than a width of the part of the operating portion that is inserted into the first groove, further comprising a cam support member for supporting the cam, wherein the cam support member is provided with a mark for determining a posture of the cam.

3. A vehicle door locking device for locking a door of a vehicle, comprising:

a switching portion having a cam that rotates according to an opening operation of a vehicle door or a closing operation of the vehicle door, and an operation portion that is engageable with the cam to restrict a rotation of the cam, wherein the cam includes a first groove for receiving a part of the operation portion for restricting rotation of the cam, wherein the first groove has a first range which allows the cam to rotate such that the vehicle door moves in an opening direction for a limited distance required for removing an object caught by the vehicle door and restricts the cam from rotating such that the vehicle door does not move in the opening direction more than the limited distance when the part of the operation is in the first groove, wherein the rotation of the cam is allowed when the part of the operation portion is out of the first groove, wherein the vehicle is provided with a door closing switch which outputs a door closing signal indicating that the door is closed, and a lock switch that outputs a lock signal indicating that the door is locked when being turned on, wherein the operating portion is configured for moving between an ON position at which the operating portion enters the first groove to turn the lock switch on, and an OFF position at which the operating portion is retracted from the first groove to turn the lock switch off, and wherein the cam has such a shape that keeps the operating portion from reaching the ON position until the door closing switch is turned on, wherein the switching portion has a solenoid that moves the operating portion to the ON position from the OFF position and vice versa, the operating portion moving to the ON position when the solenoid being demagnetized, and wherein demagnetizing of the solenoid is suspended until the door stops after having moved beyond a position at which the door closing switch is turned on and-pushed back in the opening direction.

4. The vehicle door locking device according to claim 3, wherein the first groove has an edge which comes into contact with the part of the operating portion to stop the rotation of the cam.

5. The vehicle door locking device according to claim 4, wherein the first groove has a bottom surface which comes into contact with the operating portion when the operating portion is at the ON position, and wherein the bottom surface has such a circular arc shape that keeps the operating portion from moving from the ON position to the OFF position during rotation of the cam.

6. The vehicle door locking device according to claim 4, wherein the cam includes a second groove for receiving a protruding portion formed in the door, wherein a width of the second groove in a rotating direction of the cam is a size corresponding to a width of a distal end of the protruding portion that enters the second groove, and wherein a width of the first groove in the rotating direction of the cam is larger than a width of the part of the operating portion that is inserted into the first groove.

7. A vehicle door locking device for locking a door of a vehicle, comprising:

a switching portion having a cam that rotates according to an opening operation of a vehicle door or a closing operation of the vehicle door, and an operation portion that is engageable with the cam to restrict a rotation of the cam, wherein the cam includes a first groove for receiving a part of the operation portion for restricting rotation of the cam, wherein the first groove has a first range which allows the cam to rotate such that the vehicle door moves in an opening direction for a limited distance required for removing an object caught by the vehicle door and restricts the cam from rotating such that the vehicle door does not move in the opening direction more than the limited distance when the part of the operation is in the first groove, wherein the door has a rubber member on a forward end thereof, wherein the limited distance is equal to or less than a width of the rubber, in an opening/closing direction of the door.

8. The vehicle door locking device according to claim 7, wherein the rotation of the cam is allowed when the part of the operation portion is out of the first groove.

9. The vehicle door locking device according to claim 8, wherein the vehicle is provided with a door closing switch which outputs a door closing signal indicating that the door is closed, and a lock switch that outputs a lock signal indicating that the door is locked when being turned on, wherein the operating portion is configured for moving between an ON position at which the operating portion enters the first groove to turn the lock switch on, and an OFF position at which the operating portion is retracted from the first groove to turn the lock switch off, and wherein the cam has such a shape that keeps the operating portion from reaching the ON position until the door closing switch is turned on.

10. The vehicle door locking device according to claim 9, wherein the first groove has an edge which comes into contact with the part of the operating portion to stop the rotation of the cam.

11. The vehicle door locking device according to claim 10, wherein the first groove has a bottom surface which comes into contact with the operating portion when the operating portion is at the ON position, and wherein the bottom surface has such a circular arc shape that keeps the operating portion from moving from the ON position to the OFF position during rotation of the cam.

12. The vehicle door locking device according to claim 10, wherein the cam includes a second groove for receiving a protruding portion formed in the door, wherein a width of the second groove in a rotating direction of the cam is a size corresponding to a width of a distal end of the protruding portion that enters the second groove, and wherein a width of the first groove in the rotating direction of the cam is larger than a width of the part-of the operating portion that is inserted into the first groove.

13. A vehicle door locking device for locking a door of a vehicle, comprising:

a switching portion having a cam that rotates according to an opening operation of a vehicle door or a closing operation of the vehicle door, and an operation portion that is engageable with the cam to restrict a rotation of the cam, wherein the cam includes a first groove for receiving a part of the operation portion for restricting rotation of the cam, wherein the first groove has a first range which allows the cam to rotate such that the vehicle door moves in an opening direction for a limited distance required for removing an object caught by the vehicle door and restricts the cam from rotating such that the vehicle door does not move in the opening direction more than the limited distance when the part of the operation is in the first groove, wherein the rotation of the cam is allowed when the part of the operation portion is out of the first groove, wherein the vehicle is provided with a door closing switch which outputs a door closing signal indicating that the door is closed, and a lock switch that outputs a lock signal indicating that the door is locked when being turned on, wherein the operating portion is configured for moving between an ON position at which the operating portion enters the first groove to turn the lock switch on, and an OFF position at which the operating portion is retracted from the first groove to turn the lock switch off, and wherein the cam has such a shape that keeps the operating portion from reaching the ON position until the door closing switch is turned on, wherein the part of the operating portion has a plunger movable between a position at which the plunger is in the first groove and a position at which the plunger is out of the first groove.

14. The vehicle door locking device according to claim 13, wherein the first groove has an edge which comes into contact with the part of the operating portion to stop the rotation of the cam.

15. The vehicle door locking device according to claim 14, wherein the first groove has a bottom surface which comes into contact with the operating portion when the operating portion is at the ON position, and wherein the bottom surface has such a circular arc shape that keeps the operating portion from moving from the ON position to the OFF position during rotation of the cam.

16. The vehicle door locking device according to claim 14, wherein the cam includes a second groove for receiving a protruding portion formed in the door, wherein a width of the second groove in a rotating direction of the cam is a size corresponding to a width of a distal end of the protruding portion that enters the second groove, and wherein a width of the first groove in the rotating direction of the cam is larger than a width of the part of the operating portion that is inserted into the first groove.

* * * * *